United States Patent [19]

Eberle

[11] Patent Number: 4,893,805

[45] Date of Patent: Jan. 16, 1990

[54] TRANSPORT APPARATUS FOR PRINTED PRODUCTS AND USE OF SUCH TRANSPORT APPARATUS

[75] Inventor: Jürg Eberle, Hinwil, Switzerland

[73] Assignee: Ferag AG, Hinwil, Switzerland

[21] Appl. No.: 234,731

[22] Filed: Aug. 22, 1988

[30] Foreign Application Priority Data

Aug. 28, 1987 [CH] Switzerland ..... 319/87

[51] Int. Cl.[4] ..... B65H 29/04

[52] U.S. Cl. ..... 271/204; 271/82; 271/207; 271/277

[58] Field of Search ..... 271/277, 204, 205, 206, 271/82, 207; 198/803.9

[56] References Cited

U.S. PATENT DOCUMENTS

| | | | |
|---|---|---|---|
| 3,671,035 | 6/1972 | Reist | 271/204 X |
| 3,955,667 | 5/1976 | Muller | 198/803.9 |
| 4,039,182 | 8/1977 | Reist | 271/204 X |
| 4,795,418 | 1/1989 | Reist | 271/204 X |

*Primary Examiner*—Richard A. Schacher
*Attorney, Agent, or Firm*—Bell, Seltzer, Park and Gibson

[57] ABSTRACT

An individual conveyor equipped with controlled grippers arranged at a mutual uniform spacing from one another delivers the arriving printed products up to the starting region of a removal conveyor. The removal conveyor is driven at this starting region such as to move substantially in the same sense or direction as the individual conveyor at a product removal region thereof. This removal conveyor is equipped with controlled product removal grippers or gripper elements. The mouth openings of the grippers of the individual conveyor and the mouth openings of the product removal grippers of the removal conveyor are controlled in an opposite sense with respect to one another. To render the design of the removal conveyor less complex and to reduce the noise emission during operation thereof, the product removal grippers are secured at a uniform spacing from one another at a driven endless traction element. Each of the product removal grippers have a movable jaw and a fixed jaw. The movable jaws of the product removal grippers, in the open position thereof, are laterally shifted or pivoted away from the associated fixed jaw and pre-biased by a first resilient action in this open gripper position. In the closed position of the product removal grippers the movable jaws are directed essentially in the same direction as the associated fixed jaws and are pre-biased by a second resilient action. The second resilient action overcomes the first resilient action.

8 Claims, 3 Drawing Sheets

TRANSPORT APPARATUS FOR PRINTED PRODUCTS AND USE OF SUCH TRANSPORT APPARATUS

BACKGROUND OF THE INVENTION

The present invention broadly relates to transport equipment or apparatus for the transport or conveyance of products or articles, and, more specifically pertains to a new and improved construction of a transport apparatus for the transport or conveyance of printed products.

Generally speaking, the transport apparatus for the transport of printed products, especially newspapers arriving in an imbricated or shingled formation, is of the type comprising an individual conveyor which engages the individual product copies. To that end, the individual conveyor is provided with controlled grippers or gripper elements arranged at a mutual substantially uniform or regular spacing from one another. There is also provided an endless revolving product removal conveyor which at a product removal region of the individual conveyor is driven in the same sense as such individual conveyor, in other words, is driven in a sense or direction which allows transfer of products from the individual conveyor to the product removal conveyor at the product removal region of the individual conveyor. This product removal conveyor is equipped with controlled product removal grippers or gripper elements for engaging in each case a printed product. The grippers of the individual conveyor have mouth openings and the product removal grippers have mouth openings. The mouth openings of the grippers of the individual conveyor and the mouth openings of the grippers of the product removal conveyor are directed towards or confront one another and at the product removal region of the individual conveyor the grippers thereof and the product removal grippers of the product removal conveyor are controlled in opposite sense in relation to one another. In this context, the just mentioned designation "opposite sense" means that at the product removal region of the individual conveyor the grippers thereof are opened for releasing the printed products and at the product removal conveyor the product removal grippers are closed for engaging the released printed products. In this way, there can be accomplished an orderly transfer of the printed products from the individual conveyor to the product removal conveyor.

Such type of transport apparatus is known to the art and has been disclosed in the German Patent Publication No. 2,657,691 and the extensively cognate U.S. Pat. No. 4,039,182, granted Aug. 2, 1977, to which reference may be readily had.

In this prior art transport apparatus the grippers of the product removal conveyor or removal conveyor, are each mounted upon a displaceable carriage which can travel in a closed guide rail. Each of these carriages, as will be apparent by referring to FIGS. 4 and 7 of the aforementioned German Patent Publication No. 2,657,691 and U.S. Pat. No. 4,039,182, is directly coupled with the leading and with the trailing carriage by means of a drag connection. This drag connection allows alteration of the mutual spacing of the carriages from one another between a minimum value and a maximum value. Each carriage is equipped with follower elements which, at the product removal region, engage between the threads of a driven worm which thus defines the mutual spacing of the carriages from one another at the region of such worm. In this way, the printed products, arriving from the individual conveyor, can be taken over in so-to-speak the "same phase" by the product removal conveyor. Also at the delivery region the carriages of the product removal conveyor are driven by a driven worm, and between the product removal region and the product delivery region the sequence or train of carriages of the product removal conveyor, by virtue of the drag connection provided therebetween, can be stretched or else dammed-up.

As long as the printed products are transported by the individual conveyor then the mutual product spacing is constant, in other words, the product formation is orderly and uniform. However, as soon as the printed products are taken over by the product removal conveyor and further conveyed or transported, then the uniform and orderly product formation is disturbed in the sense that the mutual spacing between the printed products alters to the same degree or extent as there is altered the mutual spacing of the carriages supporting the product removal grippers. Only at the product delivery region of the product removal conveyor is there again re-established a uniform and orderly formation of the products.

Furthermore, with the heretofore discussed prior art transport apparatus the printed products can rub or contact one another during their transport by the product removal conveyor. This can occur by virtue of the variable spacing between the product removal grippers. That phenomenon is particularly disadvantageous in the case of printed products which have been newly printed, in other words, are so-to-speak "hot off the press". Furthermore, with this heretofore known transport apparatus, due to the drive of the product removal conveyor, the technological equipment expenditure or design is appreciable both at the product removal region and at the product delivery region and also appreciable power requirements exist. Finally, during operation of this prior art transport apparatus the product removal conveyor, particularly when working at higher product transport velocities, generates or emits a considerable amount of noise.

SUMMARY OF THE INVENTION

Therefore with the foregoing in mind it is a primary object of the present invention to provide a new and improved construction of a transport apparatus for products, especially printed products, which does not suffer from the aforementioned drawbacks and shortcomings of the prior art.

Another and more specific object of the present invention aims at the provision of a transport apparatus of the previously mentioned type wherein the noted shortcomings are extensively avoided, and specifically the transport apparatus is of relatively simple construction and design, has comparatively modest power requirements and develops a minimum amount of noise during operation.

Yet a further significant object of the present invention aims at the provision of a new and improved construction of a transport apparatus for the transport or conveyance of products, typically printed products, wherein such transport apparatus affords an effective and reliable transfer of the printed products from an individual conveyor to a product removal conveyor, both conveyors operating with grippers which function in opposite or opposing sense, in other words, so-to-speak out of phase.

A further noteworthy object of the present invention is directed to a new and improved construction of a transport apparatus for the transport or conveyance of products, which transport apparatus is relatively simple in construction and design, quite economical to manufacture, extremely reliable in operation, not readily subject to breakdown or malfunction, requires a minimum of maintenance and servicing, and has comparatively low noise emission.

Now in order to implement these and still further objects of the invention, which will become more readily apparent as the description proceeds, the transport apparatus of the present development, among other things, is manifested by the features that the product removal grippers of the product removal conveyor are secured at a substantially uniform or regular spacing from one another at a driven endless traction element. The movable jaw of each product removal gripper, in the open position thereof, can be laterally displaced or pivoted away from the associated fixed jaw and can be pre-biased or loaded by a first resilient or spring action in such position, and in the closed position of each such product removal gripper the movable jaw is directed or extends substantially in the same direction or sense as the associated fixed jaw and in this position is blocked or locked by a second resilient or spring action. This second resilient or spring action overcomes the first resilient or spring action.

Advantageously, a common resilient or spring element, such as a helical or coil spring, can be utilized for generating the first resilient or spring action and the second resilient or spring action.

With the design of the inventive transport apparatus the drive of the product removal conveyor is certainly appreciably simplified and the product formation which is taken over from the individual conveyor remains practically unaltered also during the transport of the products by the product removal conveyor.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
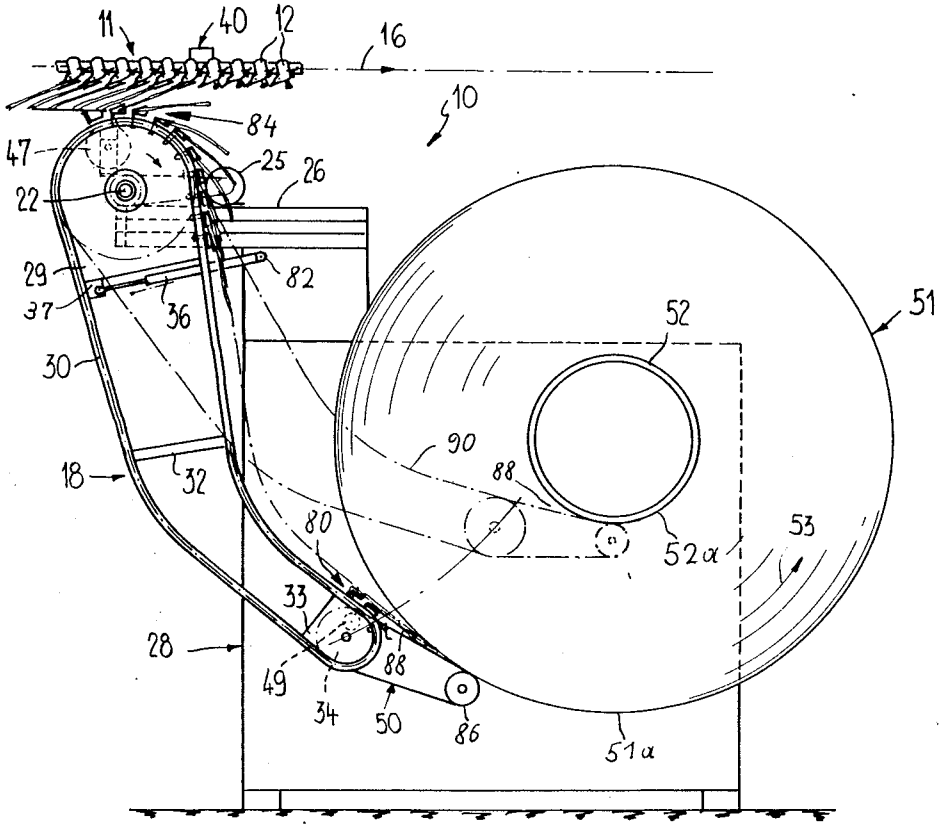
FIG. 1 is a side view of a transport apparatus constructed according to the present invention and depicting its use as an infeed or feed device for a product winding station, here a product wind-up station.
Figure 2:
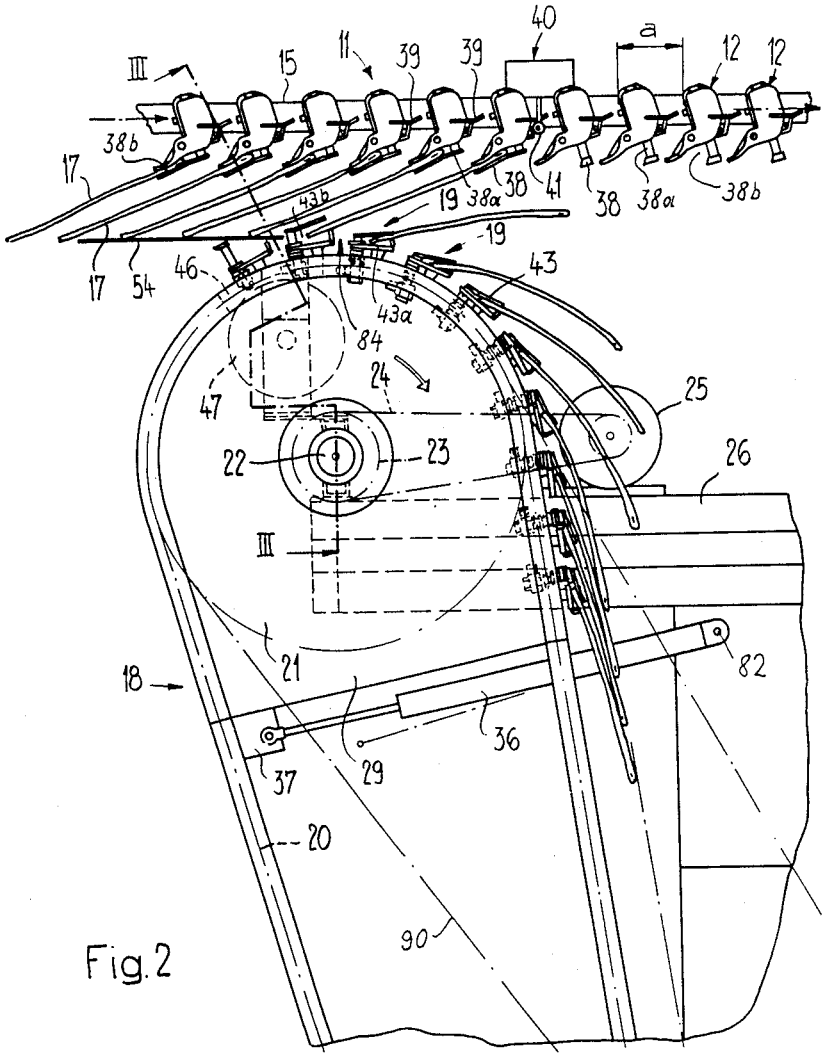
FIG. 2 illustrates on an enlarged scale a detail of the transport apparatus depicted in FIG. 1.
Figure 3:
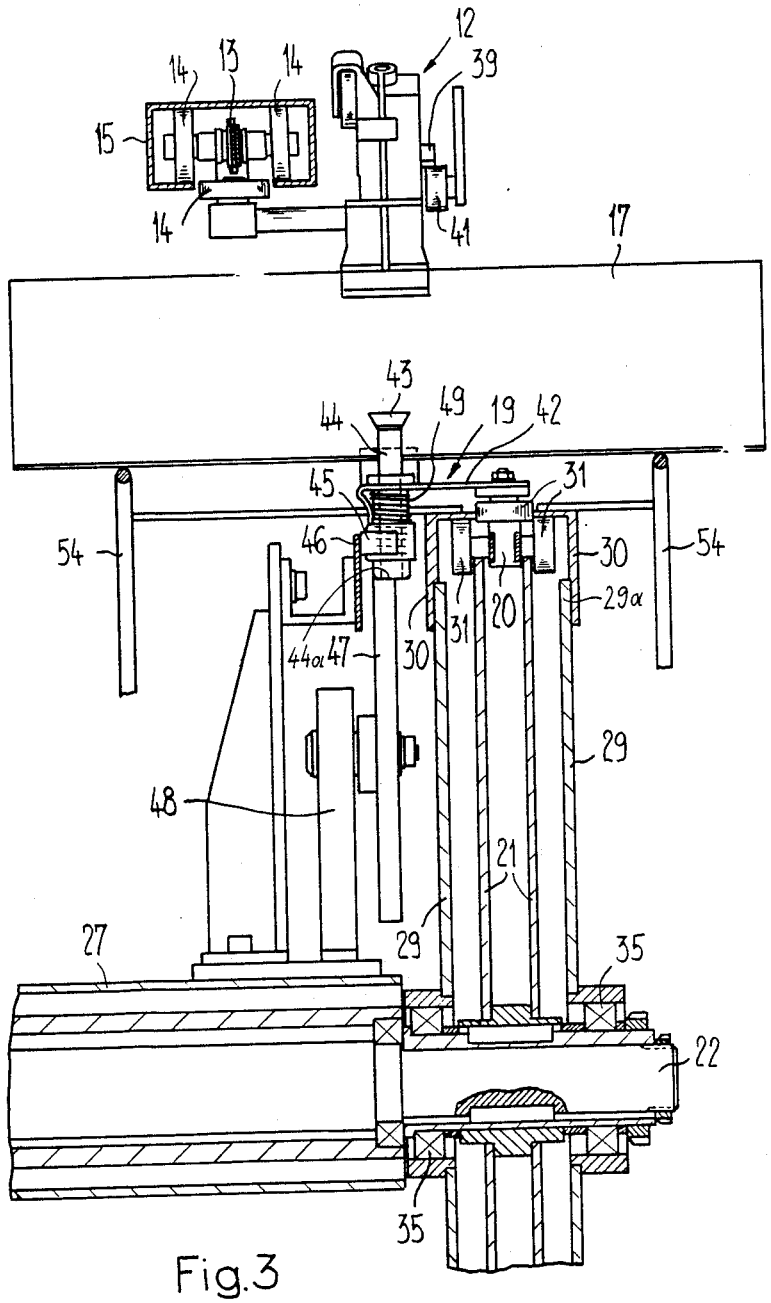
FIG. 3 is a cross-sectional view of the transport apparatus depicted in FIG. 2, taken substantially along the section line II—II thereof.

Describing now the drawings, it is to be understood that to simplify the showing thereof, only enough of the construction of the exemplary embodiment of transport apparatus has been illustrated therein as is needed to enable one skilled in the art to readily understand the underlying principles and concepts of this invention. Turning now specifically to FIGS. 1 to 3, the exemplary embodiment of transport apparatus 10 depicted therein will be seen to comprise an individual conveyor or conveyor device 11. This individual conveyor 11 can be constructed like, for instance, the individual conveyor disclosed in Swiss Patent No. 592,562 or the German Patent No. 2,519,561 and the essentially cognate U.S. Pat. No. 3,955,667, granted May 11, 1976, to which reference may be readily had and the disclosure of which is incorporated herein by reference. Still, in order to fully appreciate the teachings of the present invention, enough of the construction of the individual conveyor 11 will be described hereinafter. Thus, this individual conveyor or conveyor device 11 comprises a multiplicity of controlled grippers or gripper elements 12 which are appropriately secured or attached at a substantially uniform or equidistant spacing or pitch a (FIG. 2) from one another at an endless revolving driven traction element, for instance, a chain 13. As will be appreciated by inspecting FIG. 3, this chain or chain member 13 is guided by means of rolls or rollers 14 in an open hollow rail or rail member 15 and is driven by any suitable and therefore not particularly illustrated drive means for movement in the direction of the arrow 16 (FIG. 1). Each of the grippers or gripper elements 12 is structured such that it is able to clampingly engage or seize the leading edge of an associated printed product 17, here typified for instance by a newspaper, and to further transport the engaged printed product 17 in a more or less suspended or depending fashion, as shown in FIG. 2.

Beneath the individual conveyor or conveyor device 11 there is arranged a product removal conveyor 18, sometimes simply referred to herein as a removal conveyor. This product removal conveyor 18 likewise contains a multiplicity or plurality of controlled product removal grippers or gripper elements 19, as particularly well seen by referring to FIG. 2. These product removal grippers or gripper elements 19 are appropriately attached or secured at a substantially uniform or equidistant spacing or pitch from one another at an endless revolvingly driven traction element, likewise here shown in the form of a chain or chain member 20. As shown in FIG. 3, this chain or chain member 20 is trained about a double-walled sprocket wheel 21 or the like which is keyed or otherwise suitably fastened to a shaft or shaft member 22. At the other or opposite end of this shaft or shaft member 22, which is not visible in the showing of FIG. 3 but is depicted in FIG. 2, there is seated a sprocket wheel 23. This sprocket wheel 23 or equivalent structure is operatively connected by means of a chain or chain member 24 in driving relationship with a drive motor or drive unit 25. This drive motor 25 as well as a bearing sleeve or bushing 27 provided for the shaft 22 are fixedly mounted to a cantilever member or overhang 26 or the like, protruding from the frame or stand of a suitable winding station 28 which has only been schematically shown in FIG. 1.

The double-walled sprocket wheel 21 is mounted internally of a casing or enclosure 29 at the outer edge or end **29*a* of which there is secured a hollow rail or rail member 30. The chain 20 of the product removal conveyor 18 is guided by rolls or rollers 31 within this hollow rail 30. Moreover, this hollow rail 30 extends to a certain extent as a self-supporting structure, reinforced by a strut or stay member 32 (FIG. 1), up to a product delivery or outfeed region, generally indicated by reference character 80, of the product removal conveyor 18. At this product delivery or outfeed region 80 of the product removal conveyor 18 the hollow rail or rail member 30 supports a further casing or enclosure 33 in which there is rotatably mounted a sprocket wheel 34 or equivalent structure about which there is trained the chain or chain member 20. As will be further evident by inspecting FIG. 3, the first mentioned casing or enclosure 29, and thus also the hollow rail 30 and the entire product removal conveyor 18, are rotatably or pivotably supported by ball bearings 35 upon the shaft or shaft member 22. In this way it is possible to adjust throughout a certain range or extent the elevational position or posture of the product delivery or outfeed region 80, and specifically the position of the sprocket wheel 34 of the product removal conveyor 18**, as will again be more fully considered hereinafter.

In the embodiment under discussion the product removal conveyor 18 is subjected to the action of a tension or traction spring, for instance a gas spring 36 which is hingedly connected at one end, beneath the location of the cantilever member 26 to a stationary pivot pin or journal 82 and at the other end is hingedly connected with a bracket or carrier 37 secured to the casing or shell 29. Moreover, in this embodiment under discussion the gas spring 36 strives to pivot or rock the entire product removal conveyor 18 in counter-clockwise direction, as has been generally indicated by chain-dot lines 90 in each of FIGS. 1 and 2. As indicated, this will again be considered more fully hereinafter in conjunction with the further description of this particular exemplary embodiment of the inventive transport apparatus. However, it is to be observed, that even upon rocking or pivoting the product removal conveyor 18 the position of the sprocket wheel 21 and its drive, here constituted by the drive motor 25 and chain 24, do not experience any positional change, in other words, the position of the entire product removal region, generally indicated by reference character 84, of the individual conveyor 11 is not altered.

Continuing, it is here again remarked that details of the grippers or gripper elements 12 of the individual conveyor 11 are known in this technology and have been described in the previously mentioned German Patent Publication No. 2,519,561 and the cognate U.S. Pat. No. 3,955,667. As will be seen from FIG. 2, the movable lower jaws 38 of the grippers 12 are secured to an associated shaft **38*a* and subjected to the action of an associated opening spring which strives to not only space each movable lower jaw 38 from the associated fixed jaw 38*b* but also to retain the movable lower jaw 38 in a laterally displaced or pivoted-out position, as particularly well shown in the right-hand portion of FIG. 2. At each gripper 12 the movable lower jaw 38 forms in conjunction with the related fixed jaw 38*b* a gripper mouth opening 38*b***.

On the other hand, in the closed position of the grippers 12 each of the movable lower jaws 38 is aligned with or directed to extend in the same sense or direction as the associated fixed upper jaw **38*b* and advanced or moved thereto and held in the closed position by a conventional and therefore not here further shown locking or blocking mechanism. Operatively connected with the locking mechanism is a tongue or flag 39 or equivalent structure, as shown in FIGS. 2 and 3, and such tongue or flag 39 when lifted or otherwise appropriately actuated, unlocks or unlatches the locking mechanism so that the associated movable jaw 38** instantaneously assumes its open position and releases the related transported or conveyed printed product, here the newspaper.

Now in order to raise the tongue or flag 39 or the like, there is provided at the product removal region 84 of the individual conveyor 11, a release mechanism or device 40, as best seen by referring to FIG. 2. This release mechanism 40 here comprises an elevationally displaceable roll or roller 41 which can engage beneath the tongue or flag 39 and can be selectively raised or lowered, for instance, by means of an electromagnet. In the raised state or position the roll 41 lifts the tongue or flag 39 moving therepast and thus opens the associated gripper or gripper element 12.

A different gripper construction is provided for the product removal grippers or gripper elements 19 of the product removal conveyor 18. As will be seen by referring to FIG. 3, these product removal grippers 19 each comprise a gripper plate or plate member 42 which laterally protrudes from the chain 20 and which simultaneously carries the fixed jaw **43*a* (FIG. 2) of the related gripper or gripper element 19. A gripper mouth opening 43*b* is formed between the movable jaw 43 and the fixed jaw 43*a*. The movable jaw 43 of each gripper 19 is secured to the upper end of a lengthwise displaceable and turnable or pivotable shaft or shaft member 44 which is mounted in the gripper plate 42. At its lower end this shaft 44 carries a protruding cam follower or dog 45 which coacts with a stationary cam or cam member 46. When the cam follower 45 comes into contact with the cam member 46 then the movable jaw 43 is aligned or extends in the same direction as the associated fixed jaw 43*a* carried at the gripper plate 42. The lower end or end face 44*a* of the shaft 44, which is preferably provided with a plastic covering or coating or the like, cooperates with a cam wheel 47 having a substantially horizontally directed axis. This cam wheel or wheel member 47 is freely rotatably mounted at the upper end of a support or carrier 48 which, in turn, is mounted upon the bearing sleeve or bushing 27 of the shaft 22. When the lower end or end face 44*a* of the shaft 44 travels onto the cam wheel 47, then the shaft 44 is raised, in other words, the movable jaw or jaw member 43 is spaced from the associated fixed jaw or jaw member 43*a***.

Furthermore, a compression or pressure spring 49 encircles the shaft 44 between the gripper plate 42 and the cam follower 45, and the opposed ends of this compression or pressure spring 49 are anchored at the gripper plate 42 and at the cam follower 45, respectively. Now this compression or pressure spring 49 is mounted in such a coiled or torsioned state that such compression spring 49 not only strives to downwardly force the shaft 44 but also pivots or turns this shaft 44 to such an extent that the related movable jaw 43 is displaced or pivoted laterally or towards the side in the direction of the chain 20. On the other hand, the torsion or coiling of the compression or pressure spring 49 is not so pronounced or intensive that it is capable, through the action of its so-to-speak "restoring force" of overcoming the friction which prevails between the movable jaw 43 which is pressed by the axial effect or axially directed action of the compression spring 49 against the printed product 17 and the printed product 17 itself.

The result of this design is that as long as the jaw or jaw member 43 fixedly clamps a printed product 17, here the newspaper, or is in engagement with the associated fixed jaw **43*a*, this movable jaw 43 remains in its closed gripper position. However, as soon as the shaft 44 is raised and there is no cam present, like the cam 46, which prevents the shaft 44 from rotating by means of the cam follower 45, then the friction between the movable jaw 43, on the one hand, and the printed products 17 or, as the case may be, the associated fixed jaw 43***a*, on the other hand, is eliminated and the movable jaw 43 then suddenly laterally pivots or shifts towards the side. As a result, the corresponding gripper or gripper element 19 assumes its open gripper position and releases the printed product 17 which was previously fixedly clamped at its trailing product edge.

Since for opening each gripper or gripper element 19 it is only necessary to lift its shaft or shaft member 44, a cam wheel 49, analogous to the cam wheel 47, is provided at the product delivery or outfeed end, in other words at the product delivery region 80 of the product removal conveyor 18, as shown in FIG. 1, but at that location there need not be provided at the region of the sprocket wheel 34 any cam corresponding to the cam or cam member 46.

In the embodiment under discussion and as can be seen in FIG. 1, a belt or band conveyor or conveyor device 50 merges with and follows the sprocket wheel 34, and the one deflection roll of this belt or band conveyor 50 is coaxially mounted with respect to the sprocket wheel 34 and is fixedly connected for rotation therewith. The other deflection roll or roller, here indicated by reference character 86, of this band or belt conveyor 50 is rotatably mounted at the end of a not particularly illustrated cantilever or overhang member which extends from the casing or enclosure 33. The band or belt conveyor 50 together with the outer surface or circumference 51*a* of a product package 51 which is in the process of being formed at the winding station or frame unit 28, or, as the case may be, then with the outer surface or circumference 52*a* of a winding core or mandrel 52 for the product package 51 to be formed, when the product removal conveyor 18 has assumed the chain-dot position depicted in FIG. 1, forms a clamping nip or gap 88. In this clamping nip or gap 88 the printed products 17, here the newspapers, taken over by the product removal conveyor 18 are wound in conjunction with a not particularly illustrated but conventional winding band or strap upon the winding core 52 and the product package 51 formed thereupon and which rotates in the direction of the arrow 53 of FIG. 1.

The previously mentioned gas spring 36 ensures that the product removal conveyor 18 and in conjunction therewith the belt conveyor 50 are accommodated to the increasing diameter of the formed product package 51 without there being necessitated adjustments or equipment re-setting work at the product removal region 84 disposed at the location of the sprocket wheel 21.

The spacing of the product removal grippers 19 from one another and the diameter of the sprocket wheel 21 are coordinated or matched to one another such that the spacing of these grippers 19 during their revolving motion about the sprocket wheel 21 exactly corresponds to the spacing or pitch a between the grippers 12 of the individual conveyor 11. Since, however, as will be apparent from the illustration of FIGS. 2 and 3, the location where the printed products 17 are clampingly seized by the grippers 19, protrudes or extends radially outwardly from the chain or chain member 20, there exists the situation that the printed products 17 which have been taken over by the product removal conveyor 18, are transported in a somewhat consolidated imbricated product stream or formation by the linear sections or portions of the product removal conveyor 18 and are transferred in this condition to the product package 51 which is in the process of being formed. In any event, the formation of the printed products 17 taken over from the individual conveyor 11 is maintained.

In order to facilitate the take-over or transfer of the printed products 17 to the product removal conveyor 18, a pair of slide or guide rails or rail members 54 or equivalent structure are arranged ahead of the product removal region 84, in other words slightly upstream of the sprocket wheel 21 as can be seen in FIG. 2. At higher conveying velocities this pair of slide or guide rails 54 prevents undesired fluttering of the printed products 17, here the newspapers, which are infed by the individual conveyor 11 and also serves to place the trailing product edges at the correct elevational position so that the printed products 17 can be properly gripped or engaged by the product removal grippers or gripper elements 19.

While there are shown and described present preferred embodiments of the invention, it is to be distinctly understood that the invention is not limited thereto, but may be otherwise variously embodied and practiced within the scope of the following claims. ACCORDINGLY,

WHAT I CLAIM IS:

1. A transport apparatus for transporting printed products, especially newspapers arriving in an imbricated formation, comprising:

an individual conveyor for engaging the printed products for transport thereof in a predeterminate direction;

said individual conveyor being provided with a plurality of controlled grippers arranged at a substantially uniform spacing from one another for the clamping engagement of the printed products;

said individual conveyor defining a product removal region;

a driven endless revolving product removal conveyor moving substantially in the same sense as the individual conveyor at the region of the product removal location thereof;

said product removal conveyor being provided with controlled product removal grippers;

each of said product removal grippers engaging an associated printed product;

each of said grippers of said individual conveyor having a mouth opening;

each of said product removal grippers of said product removal conveyor having a mouth opening;

the mouth openings of said grippers and the mouth openings of said product removal grippers confronting one another;

means for controlling the grippers of the individual conveyor at the product removal location;

means for controlling the product removal grippers of the product removal conveyor;

said controlling means for the grippers of the individual conveyor and said controlling means for the product removal grippers of the product removal conveyor controlling said grippers and said product removal grippers, respectively, at the product removal region such that said grippers and product removal grippers are oppositely controlled in relation to one another;

said product removal conveyor comprising a driven endless traction element;

said product removal grippers of the product removal conveyor being arranged at a substantially uniform spacing from one another at the driven endless traction element;

each of said product removal grippers comprising a movable jaw and an associated fixed jaw;

means for pivoting the movable jaw of each product removal gripper into an open gripper position laterally of the associated fixed jaw and for pre-biasing the movable jaw in said open gripper position by a first resilient action;

each product removal gripper in a closed gripper position thereof having the movable jaw directed substantially in the same direction as the associated fixed jaw;

means for blocking the movable jaw of each product removal gripper in said closed gripper position by a second resilient action;

said second resilient action overcoming the first resilient action;

a shaft provided for each product removal gripper;

the movable jaw of each product removal gripper being secured to said shaft thereof;

cantilever means provided for each shaft and laterally protruding from said driven endless traction element;

each shaft being pivotably and axially displaceably mounted at the cantilever means thereof;

said means for pivoting the movable jaw of each product removal gripper comprises a compressible and torsionable helical spring surrounding the shaft of the associated product removal gripper;

said helical spring being pre-biased in a closing direction of the associated product removal gripper;

said helical spring in a relaxed and non-torsioned state thereof retaining the movable jaw in the laterally pivoted out position;

endless guide rail means;

said traction element being guided in said endless guide rail means;

a driven deflection wheel; and said traction element being trained about said driven deflection wheel at the product removal region.

2. The transport apparatus as defined in claim 1, wherein:

said means for pivoting the movable jaw laterally of the associaged fixed jaw and the means for blocking the movable jaw in the closed gripper position comprise common resilient means.

3. A transport apparatus for transporting printed products, especially newspapers arriving in an imbricated stream, comprising:

an individual conveyor for engaging the printed products for transport thereof in a predeterminate direction;

said individual conveyor being provided with a plurality of controlled grippers arranged at a substantially uniform spacing from one another for the clamping engagement of the printed products;

said individual conveyor defining a product removal region;

a driven endless revolving product removal conveyor moving substantially in the same sense as the individual conveyor at the region of the product removal location thereof;

said product removal conveyor being provided with controlled product removal grippers;

each of said product removal grippers engaging an associated printed product;

each of said grippers of said individual conveyors having a mouth opening;

each of said product removal grippers of said product removal conveyor having a mouth opening;

the mouth openings of said grippers and the mouth openings of said product removal grippers confronting one another;

means for controlling the grippers of the individual conveyor at the product removal location;

means for controlling the product removal grippers of the product removal conveyor;

said controlling means for the grippers of the individual conveyor and said controlling means for the product removal grippers of the product removal conveyor controlling said grippers and said product removal grippers, respectively, at the product removal region such that said grippers and product removal grippers are oppositely controlled in relation to one another;

said product removal conveyor comprising a driven endless traction element;

said product removal grippers of the product removal conveyor being arranged at a substantially uniform spacing from one another at the driven endless traction element;

each of said product removal grippers comprising a movable jaw and an associated fixed jaw;

means for pivoting the movable jaw of each product removal gripper into an open gripper position laterally of the associated fixed jaw and for pre-biasing the movable jaw in said open gripper position by a first resilient action;

each product removal gripper in a closed gripper position thereof having the movable jaw directed substantially in the same direction as the associated fixed jaw;

means for blocking the movable jaw of each product removal gripper in said closed gripper position by a second resilient action;

said second resilient action overcoming the first resilient action;

endless guide rail means;

said traction element being guided in said endless guide rail means;

a driven deflection wheel; and said traction element being trained about said driven deflection wheel at the product removal region.

4. The transport apparatus as defined in claim 3, wherein:

the substantially uniform spacing of the product removal grippers from one another and the substantially uniform spacing of the grippers of the individual conveyor from one another essentially correspond to one another at the region of the deflection wheel.

5. The transport apparatus as defined in claim 3, wherein:

said deflection wheel has an axis of rotation;

said product removal conveyor having a product delivery region; and means for pivotably mounting said endless guide rail means about the axis of rotation of the deflection wheel in order to alter the elevational position of said product delivery region of the product removal conveyor.

6. The transport apparatus as defined in claim 5, wherein:

said means for controlling the product removal grippers comprise means provided in the vicinity of the product removal region of the individual conveyor for raising the movable jaw of each product removal gripper when in the closed gripper position and means for pivoting the movable jaw of each product removal gripper into the closed gripper position; and said raising means and said pivoting means being stationarily arranged with respect to the individual conveyor.

7. The transport apparatus as defined in claim 6, wherein:

each said raising means and said pivoting means comprise cam means.

8. The transport apparatus as defined in claim 5, wherein:

said transport apparatus is provided as a product infeed device to a winding station for the printed products;

means defining a winding station for receiving printed products from the product removal conveyor and for winding up the printed products to form a product package;

a band conveyor arranged following the product delivery region of the product removal conveyor;

said band conveyor being immobile in relation to the product removal conveyor; and means for applying a force to the product removal conveyor which forces the band conveyor against an outer surface of the product package which is being formed at the winding station.

* * * * *